United States Patent [19]

Brown

[11] 4,244,615

[45] Jan. 13, 1981

[54] LIFTING SPREADER ACTUATED CRANK

[75] Inventor: James A. Brown, Moraga, Calif.

[73] Assignee: Matson Navigation Company, San Francisco, Calif.

[21] Appl. No.: 43,202

[22] Filed: May 29, 1979

[51] Int. Cl.[3] ..... B63B 25/00; B66C 1/66

[52] U.S. Cl. ..... 294/67 DA; 294/81 SF; 410/78

[58] Field of Search ..... 294/67 R, 67 D, 67 DA; 114/75; 206/503, 504; 220/1.5, 23.2, 23.4, 23.6; 410/69, 77–81, 84, 85; 414/137–139

[56] References Cited

U.S. PATENT DOCUMENTS

| | | | |
|---|---|---|---|
| 3,081,120 | 3/1963 | Heinmiller et al. | 294/67 DA |
| 3,399,921 | 9/1968 | Trost et al. | 410/80 X |
| 3,543,951 | 12/1970 | Marvin | 206/503 |
| 3,734,308 | 5/1973 | Pasternack | 410/80 |
| 3,776,169 | 12/1973 | Strecker | 114/75 X |
| 3,899,092 | 8/1975 | Nordstrom | 410/77 X |
| 3,980,185 | 9/1976 | Cain | 294/67 DA X |

FOREIGN PATENT DOCUMENTS

| | | | |
|---|---|---|---|
| 843682 | 8/1960 | United Kingdom | 410/80 |

*Primary Examiner*—Johnny D. Cherry
*Attorney, Agent, or Firm*—Townsend and Townsend

[57] ABSTRACT

A corner casting of the type used for lifting and moving containers is mounted to auxiliary apparatus such as a spreader for holding deckloading cargo. The corner casting is configured for actuating a crank upon the penetration of the lifting hook. When the hook penetrates at the top hole of the corner casting, a pedal pad is depressed. The pedal pad in turn is attached to a lever arm having a pivot at one end, the pedal pad at the other end and a pivotally attached spring bias rod therebetween. Upon twistlock penetration, the spring biased rod produces crank rotation at a protruding eccentric from a crank. By using the spring biased rod rotary motion can be imparted to the crank so that lifting of the spreaders effects automated container release in the case of the disclosed equalizer.

8 Claims, 3 Drawing Figures

LIFTING SPREADER ACTUATED CRANK

FIELD OF THE INVENTION

This invention relates to the remote handling of cargo at corner castings by lifting spreaders and particularly illustrates a corner casting assembly wherein rotary motion is produced upon the penetration of a lifting hook into the upper opening of a corner casting.

BACKGROUND OF THE INVENTION

Deck loaded cargo can now be secured by spreaders extending across the upper rows of side-by-side cargo containers. Typically, these spreaders and/or equalizers grasp and firmly hold cargo in side-by-side relation once they are deposited on top of a group of containers.

It is desirable to remotely place such spreaders on top of a stack. Therefore, when such equalizer spreaders are grasped by a conventional lifting spreader, release from the cargo containers on which they have been placed is desired. Preferably, this release must be automated.

Heretofore, outwardly extending bars have accomplished these functions. When a spreader is placed on top of the bar, the bar reciprocates downwardly. Upon downward reciprocation, an eccentric imparts rotary motion to a shaft. The shaft in turn withdraws corner hooks from the side openings of castings. Thus when the equalizer spreader is grasped by a conventional loading spreader, detachment from the underlying containers on which the equalizer spreader has been placed, remotely occurs. The spreader may be lifted.

Unfortunately, such rods made to bias against the undersides of spreaders met with difficulty. Typically, since the spreaders are given what may at best be described rough treatment, their undersurfaces are often irregular. Frequently, they are bent and warped to a degree wherein predictable depression of the underlying bar cannot always be counted on.

Secondly, and due to the high speed function in which modern off-loading and on-loading occurs, there is oft times great relative motion between the relatively heavy spreader and the equalizer or load stabilizing spreader which is grasped. This being the case, the spreader oft times slams into the bar and produces bending. The bar once bent, renders the remote attachment features of the equalizer spreader inoperative. There results the need for costly repair.

SUMMARY OF THE INVENTION

A corner casting of the type used for lifting and moving containers is mounted to auxiliary apparatus such as a spreader for holding deckloading cargo from toppling overboard, as disclosed in U.S. Patent Application Ser. No. 887,571 entitled "Deck Container Restraint Apparatus and Process". The corner casting is configured for actuating a crank upon the penetration of the lifting hook. Whe the hook penetrates at the top hole of the corner casting, a pedal pad is depressed. The pedal pad in turn is attached to a lever arm having a pivot at one end, the pedal pad at the other end and a pivotally attached spring bias rod therebetween. Upon twistlock penetration, the spring biased rod produces crank rotation at a protruding eccentric from a crank. By using the spring biased rod rotary motion can be imparted to the crank so that lifting of the spreaders effects automated container release in the case of the disclosed equalizer.

OBJECTS, ADVANTAGES AND FEATURES

An object of this invention is to place a lever actuating crank within the interior of a conventional containing corner casting. According to this aspect of the invention, a lever pivoted at one end has a pedal disposed immediately below the upper corner casting opening. Upon penetration of a lifting hook, the lever is depressed. Medially located between the pedal and pivot point of the crank, there is provided a rod for reciprocation. This rod communicates through to an eccentric, and provides for shaft rotation upon penetration of a lifting hook.

An advantage of this is that the reciprocating motion is provided by a pedal, which pedal is in a completely protected environment against a swinging spreader. Since the upper openings of corner castings only receive penetration by the hooks and no relative lateral motion by the hooks, there results a completely protected crank assembly. Bending of the pedal pads when disposed within the confines of the corner casting is not possible.

A further advantage of this invention is that the pedal pad interior of the corner casting is in a universally adaptable environment. All types of corner castings now in use can be adopted to this invention. The only requirement being that they be penetrated by a lifting hook biased by a substantial weight for automatic actuation.

A further advantage of this invention is that it relies solely on the penetration of the lifting hook into the upper fitting of the corner casting. There is no need for either manual, hydraulic or electrical connections to be made.

A further advantage of this invention is that the disclosed apparatus utilizes a minimum number of reciprocating fittings. Possibilities of binding and the like are remote.

Other objects and features of this invention will become more apparent after referring to the following specification, claims and drawings in which:

Figure 3:
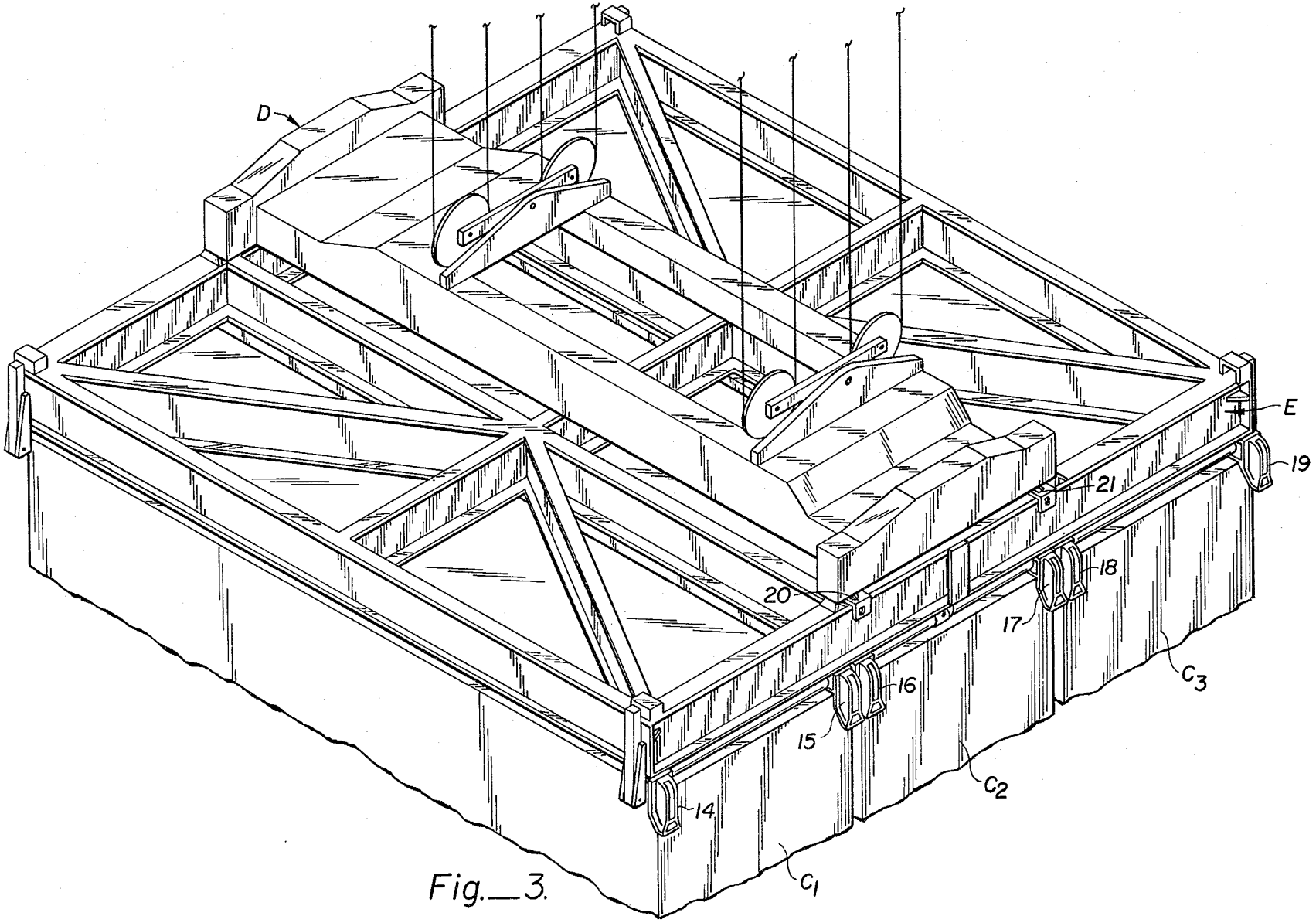
FIG. 3 illustrates an equalizer spreader on which this invention may be used.

Referring first briefly to FIG. 3, an equalizer E is shown being coupled to a lifting spreader D. The equalizer E at corner catch mechanisms 14 and 15 latches on to the corner container $C_1$; at 16 and 17 latches on to the corner container $C_2$; and, at mechanisms 18 and 19 latches on to the corner container $C_3$. Like cap mechanisms on the opposite sides of the equalizer E produce like result.

The problem here is to remotely disengage the equalizer E from the tops of all three containers simultaneously when a lifting spreader D grasps the equalizer. This is done by the mechanisms illustrated in FIGS. 1 and 2.

Figure 1:
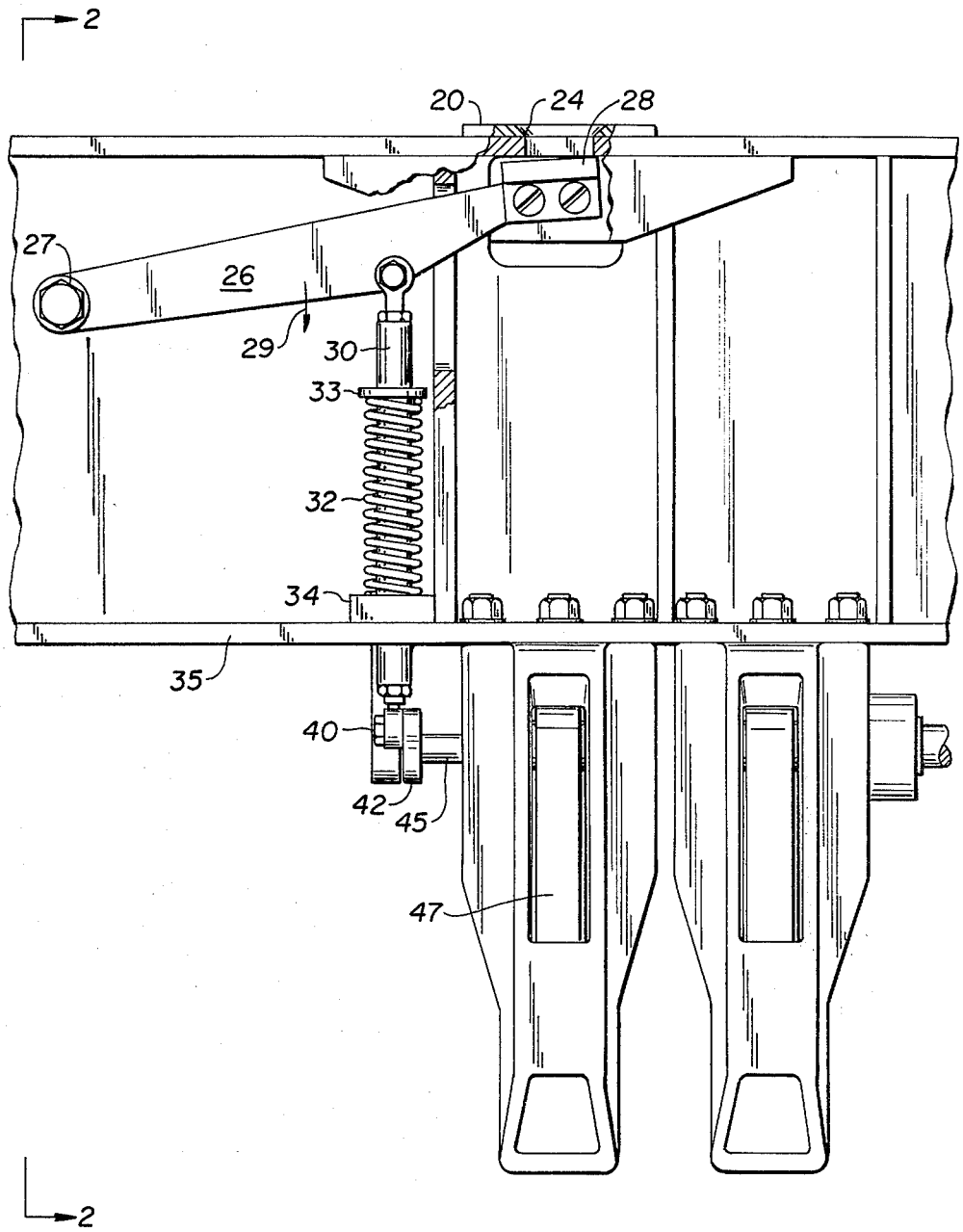
FIG. 1 is a side elevation section of the corner casting mechanism of this invention illustrating a pedal pad lever arm medially located spring biased crank therebetween.
Figure 2:
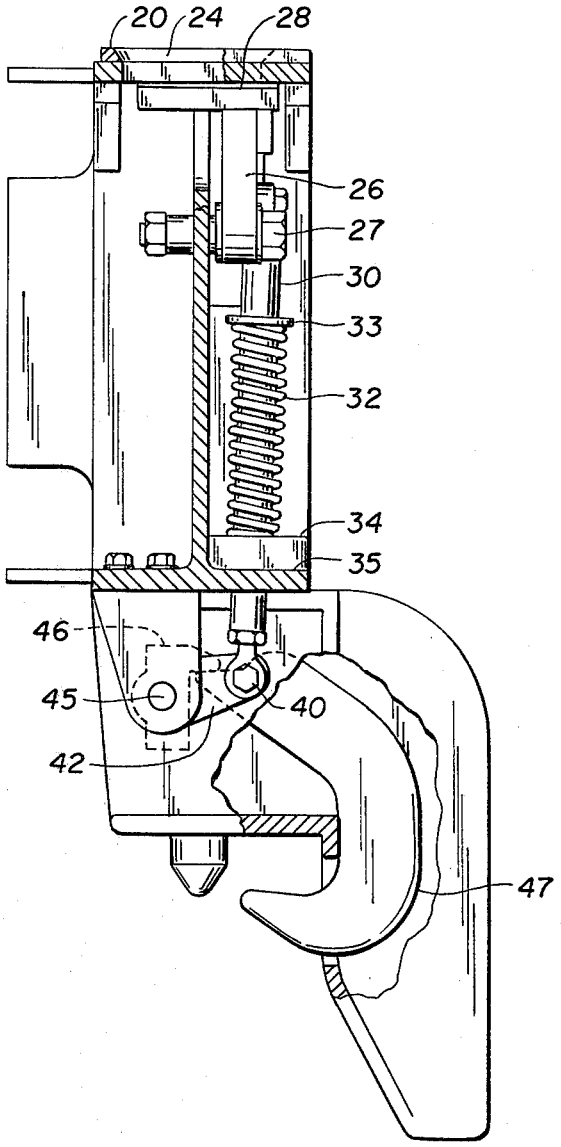
FIG. 2 is a side elevation section of the crank of FIG. 1 taken along lines 2—2 of FIG. 1.

It will be observed, that the upward portion of the equalizer E includes an upwardly exposed corner casting block 20 and 21, block 20 is illustrated in FIGS. 1 and 2 and illustrates turning of a crank mechanism.

Block 20 is provided with an aperture 24, which aperture 24 defines a standard upwardly exposed corner block mechanism.

Immediately underlying aperture 24, there is provided a lever arm 26 pivoted at one end by a bolt connection 27 and provided at the opposite end with a pedal pad 28. Upon the penetration of a twist lock fitting of a lifting spreader, lever arm 26 rotates downwardly in the direction of arcuate arrow 29.

Medially between the pivot 27 and the pedal pad 28 there is provided a reciprocating rod 30. Rod 30 is typically spring biased in the upward position by a coil spring 32 between a washer 33 and a plate 34 affixed to the flange of an eye beam 35.

Operation upon downward movement of pedal plate 28 in response to a penetrating container hook is easy to understand. Typically, rod 30 reciprocates downwardly against the bias of spring 32 compressing the spring. The remainder of the operation can be easily understood with reference to FIG. 2.

Rod 30 at a lower pivot 40 attaches to an eccentric crank 42. Crank 42 in turn is attached to a shaft 45. Shaft 45 turns a cam mechanism 46 which in turn outwardly rotates a hook 47.

It can therefore be seen that when penetration of the corner casting occurs, outward pivoting of the hooks is provided. Remote disengagement of the hooks occurs.

It will be appreciated that the mechanism here shown is specifically utilized with equalizer spreaders. It could just as well be used with other remote mechanisms. For example, specialized containers upon being lifted may require releasable features all actuated by shaft rotation. Naturally the mechanism herein provided can provide these features.

It should be further emphasized, that when the pedal 28 is in the depressed position interior of a conventional corner casting, both end and side apertures of the corner casting can still be utilized for lifting or grasping. In other words, the feature interior of the corner casting does not restrict the other conventional utilities of the corner casting. Likewise, modification can be made to this invention without departing from the spirit thereof.

What is claimed is:

1. In combination with a lifting spreader having a penetrating lifting hook and an underlying block having an upwardly exposed cavity for insertion of said lifting hook therein, a mechanism for producing rotary motion to a shaft upon penetration of said lifting hook into said cavity, said mechanism comprising: a lever arm pivoted at one portion and provided with a pedal pad at another portion, said lever arm disposed with said pedal pad immediately below said cavity for downward movement upon penetration of said lifting hook into said cavity and into engagement with said pedal pad; means for pivoting said shaft responsive to movement of said lever arm whereby movement of said lever arm responsive to the insertion of said lifting hook into said cavity causes rotation of said shaft.

2. The combination of claim 1 and wherein said lever arm is pivoted at one end and has said pedal pad at the opposite end.

3. The combination of claim 1 and including a rod pivotally attached to said lever arm between said pedal pad and said one pivoted portion, said rod configured for upward and downward movement upon corresponding upward and downward movement of said pedal pad.

4. The combination of claim 3 and wherein said rod is biased to move said pedal pad into the upward position.

5. An improved mechanism for providing rotation of a shaft upon penetration by a lifting hook into an upwardly disposed cavity of a block, said mechanism comprising in combination: a lever arm, said lever arm attached for pivotal motion at one portion and having a pedal pad at another portion, said pedal pad disposed immediately below said cavity; means for attaching said lever arm to an eccentric pivot, said eccentric pivot coupled to said shaft whereby movement of said pedal pad causes corresponding movement of said shaft.

6. The invention of claim 5 and including a rod attached at one end to said lever arm at a distance from said one pivotal portion, said rod reciprocally movable upon depression of said lever arm at said pivot pad; the opposite end of said rod attached to said eccentric pivot.

7. The invention of claim 5 and wherein said one pivotal portion is at one end of said lever arm and said pedal pad is at the opposite end of said lever arm.

8. In a mechanism for releasing a container engaging hook upon the penetration of a lifting hook of a lifting spreader into an upwardly directed cavity of a container engaging beam, the improvement comprising: a pedal pad disposed immediately below said upwardly directed cavity, said pedal pad attached to a lever arm with said lever arm pivotally connected to said beam at one end and said pedal pad at the opposite end; a reciprocating rod having upper and lower ends, said upper end attached to said lever arm and disposed for reciprocation upon movement of said pedal pad when said lifting hook penetrates said cavity; the lower end of said rod attached to an eccentric crank, said crank fixedly attached to a shaft to provide rotation of said shaft upon penetration into said cavity by said lifting hook, said shaft operably coupled to said container engaging hook so that rotation of said shaft causes said container engaging hook to be displaced.

* * * * *